US005853039A

United States Patent [19]

Fraser et al.

[11] Patent Number: 5,853,039

[45] **Date of Patent: *Dec. 29, 1998**

[54] COUPLER FOR THE TILT WAND AND PULL CORD OF A COVERING ON ARCHITECTURAL OPENING

[75] Inventors: Donald E. Fraser, Owensboro, Ky.; Barbara A. Randle, Broomfield, Colo.; Brad H. Oberg, Westminster, Colo.; Jason T. Throne, Steamboat Springs, Colo.

[73] Assignee: Hunter Douglas Inc., Upper Saddle River, N.J.

Related U.S. Application Data

[60] Provisional application No. 60/016,130 Apr. 24, 1996.

[21] Appl. No.: 837,811

[22] Filed: Apr. 22, 1997

[51] Int. Cl.[6] ..... E06B 9/36

[52] U.S. Cl. ..... 160/178.1 V; 160/168.1 V; 160/176.1 V

[58] Field of Search ..... 160/168.1 V, 176.1 V, 160/178.1 V, 178.1 R; 16/122, 121

[56] References Cited

U.S. PATENT DOCUMENTS

| | | | |
|---|---|---|---|
| 4,936,369 | 6/1990 | Darner | 160/176.1 V X |
| 5,465,775 | 11/1995 | Biba et al. | 160/168.1 R |
| 5,465,779 | 11/1995 | Rozon | 160/168.1 V X |
| 5,518,057 | 5/1996 | Huang . | |
| 5,553,649 | 9/1996 | Chisaka et al. | 160/168.1 R |
| 5,657,807 | 8/1997 | Hsu | 160/178.1 V |

FOREIGN PATENT DOCUMENTS

| | | |
|---|---|---|
| 249267 | 6/1995 | Taiwan . |
| 255450 | 8/1995 | Taiwan . |
| 261750 | 11/1995 | Taiwan . |

*Primary Examiner*—Blair M. Johnson
*Attorney, Agent, or Firm*—Dorsey & Whitney LLP

[57] ABSTRACT

A coupler for use with the tilt wand and pull cord of a window treatment system includes a cylindrical body having a longitudinal passageway adapted to receive the tilt wand and a pair of parallel longitudinal channels adapted to receive the pull cord. The longitudinal passageway communicates with an enlarged pocket adapted to receive a collar fixedly mounted to the tilt wand. The coupler encircles the tilt wand and is fixed to the tilt wand at a position along the length of the tilt wand to maintain a taut condition in the pull cord.

17 Claims, 4 Drawing Sheets

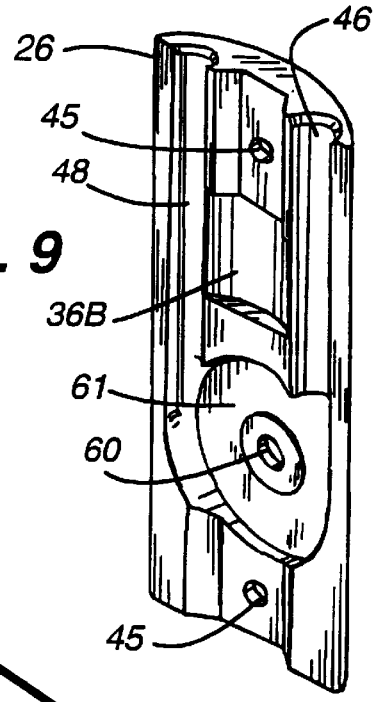
Fig. 9
Fig. 8
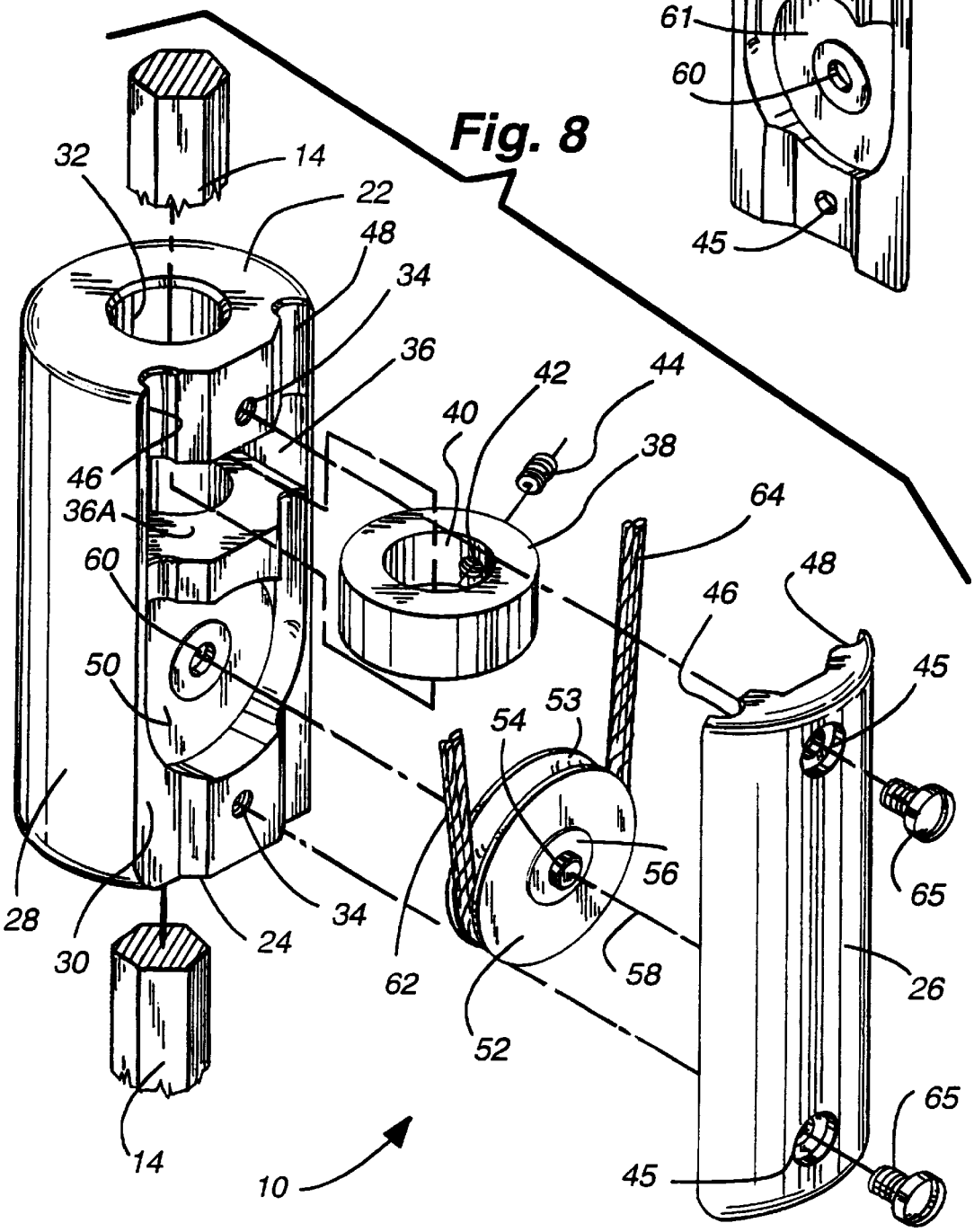

COUPLER FOR THE TILT WAND AND PULL CORD OF A COVERING ON ARCHITECTURAL OPENING

CROSS REFERENCE TO RELATED APPLICATION

This application claims the benefit of U.S. provisional application No. 60/016,130 filed Apr. 24, 1996.

BACKGROUND OF THE INVENTION

1. Field of the Invention

The present invention relates to coverings for architectural openings such as windows wherein the covering utilizes a tilt wand and pull cord control system. More particularly, the present invention relates to a coupler for operatively combining a rigid tilt wand used to control the angle of slats used in vertical or horizontal "Venetian Blind" type covering systems and a continuous pull cord used to draw the blinds.

2. Description of the Known Art

Coverings for architectural openings such as windows conventionally include a plurality of spaced apart, parallel slats which may be either horizontal or vertical. When the slats are horizontal, a head rail and a bottom rail are employed. When the slats are vertical, a single head rail is employed. Tilting of horizontal slats or rotation of vertical slats is controlled by rotation of a substantially rigid tilt wand mounted at one end of the head rail. The degree of extension or retraction of the slats across an architectural opening such as a window, is controlled by a pull cord. When the slats are vertically oriented, retraction of the covering typically results in closely adjacent stacking of the vertical slats depending at one or both ends from the head rail. When the slats are horizontally oriented, retraction of the covering typically results in a stacking of the slats immediately underneath the elongated head rail.

However, the presence of a continuous pull cord or coupled ends of a pull cord joined by a conventionally used tassel cap has sometimes proved to be dangerous to small children. Injury can occur if the child inserts its head in the closed loop of the pull cord and falls while the child's neck rests in the loop.

Safety techniques for releasing pull cords from a tassel cap when the pull cords are spread apart in an outwardly direction have been developed. For example, Taiwanese patent specification No. 249267 teaches a tassel cap for releasably restraining the paired knotted ends of a pull cord. The substantially hemispherical cap illustrated in patent specification No. 249267 includes a circular ridge crossed by a pair of channels, each ending in a pair of opposed enlarged openings. In normal operation, when the pull cord is in a vertical orientation and hanging freely, the knotted ends of the effectively closed loop pull cord remain lodged under the ridge. However, if either side of the pull cord is pulled in an oblique or transverse direction away from the center of the cap, as might happen if a child's head was inserted into the closed loop, the cord travels along one of the channels until the knotted end becomes free of the cap by passing through one of the enlarged openings.

Also by way of example, Taiwanese utility model specification No. 255450 includes an illustration of a tassel cap having a small opening near the apex of a curved cap which is connected via a short channel with a slightly larger opening lower on the side of the curved cap. It appears that a knotted pull cord lodged underneath the small opening might be dislodged if the cord is pulled downwardly in a horizontal direction, causing the cord to travel along the channel until the knot is able to pass through the larger opening.

In addition to posing a possible risk of injury to children, freely hanging pull cords sometimes get entangled in window blind slats or adjacent furniture. As a result, pull cords can sometimes be awkward to retrieve, giving the window treatment system a disorderly appearance.

OBJECTS OF THE INVENTION

It is the principal object of the present invention to provide an improved system for retaining the pull cord of a covering for an architectural opening.

It is another object of the present invention to provide a covering for an architectural opening having improved safety features.

It is a further object of the present invention to provide a covering for an architectural opening with an improved aesthetic appearance.

SUMMARY OF THE INVENTION

In accordance with the foregoing objects, the present invention is embodied in a coupler for a covering for an architectural opening hereinafter referred to as a window covering even though the invention would find use in coverings for other forms of architectural openings. The coupler is specifically useful in a window covering having parallel slats, a pull cord and a tilt wand. The coupler includes a body that slidably retains the lower loop of a closed loop pull cord while being rotatably fixed to the tilt wand at a predetermined location along the length of the tilt wand. The fixed connection to the tilt wand retains a taut condition in the depending segments of the closed loop pull cord thereby retaining a close relationship between the depending segments of the pull cord minimizing the risk of an object, such as a child's head, being encaptured between the segments and at the same time retaining an orderly appearance.

BRIEF DESCRIPTION OF THE DRAWINGS

FIG. 8 is a fragmentary exploded view of the coupler shown in FIGS. 1–7, showing its operative connection to the tilt wand and pull cord.

FIG. 9 is an isometric view of the cap portion of the coupler shown in FIGS. 1–8.

DETAILED DESCRIPTION

Figure 1:
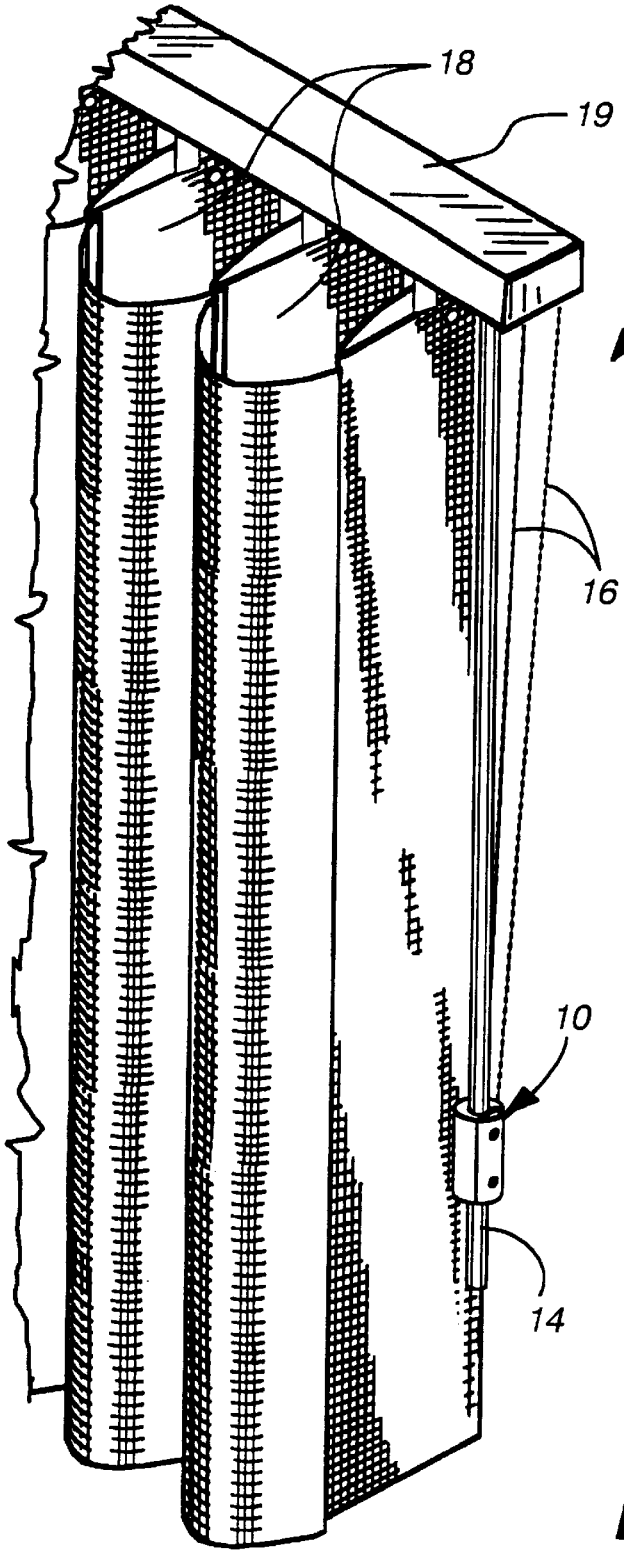
FIG. 1 is an isometric view of a vertical window covering incorporating the coupler of the present invention, in which a pull cord and a tilt wand are maintained in substantially vertical and parallel orientation.
Figure 2:
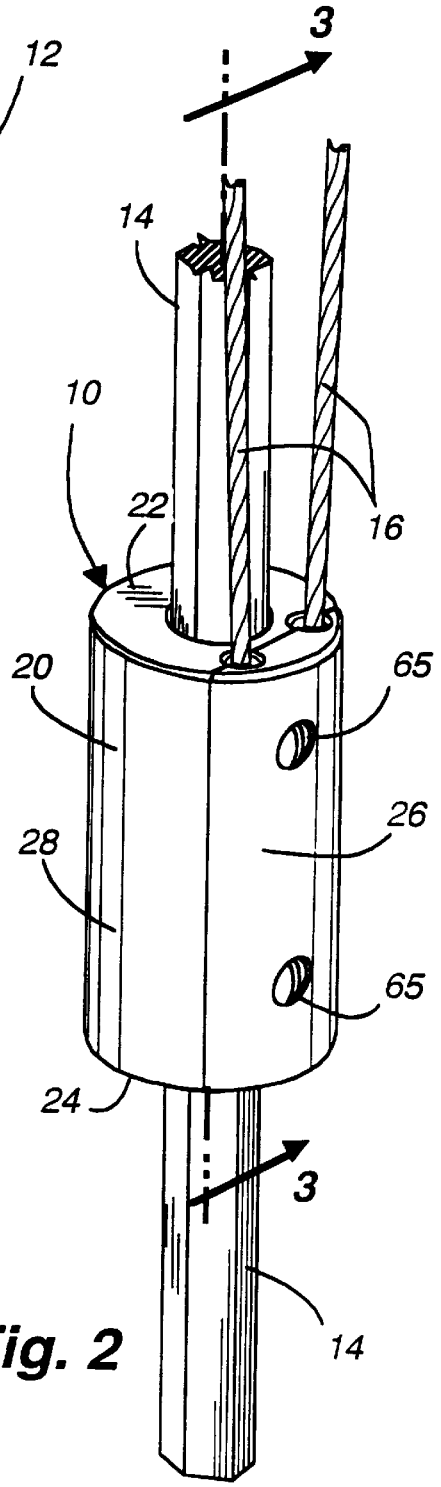
FIG. 2 is an enlarged fragmentary isometric view of the coupler shown in FIG. 1.
Figure 3:
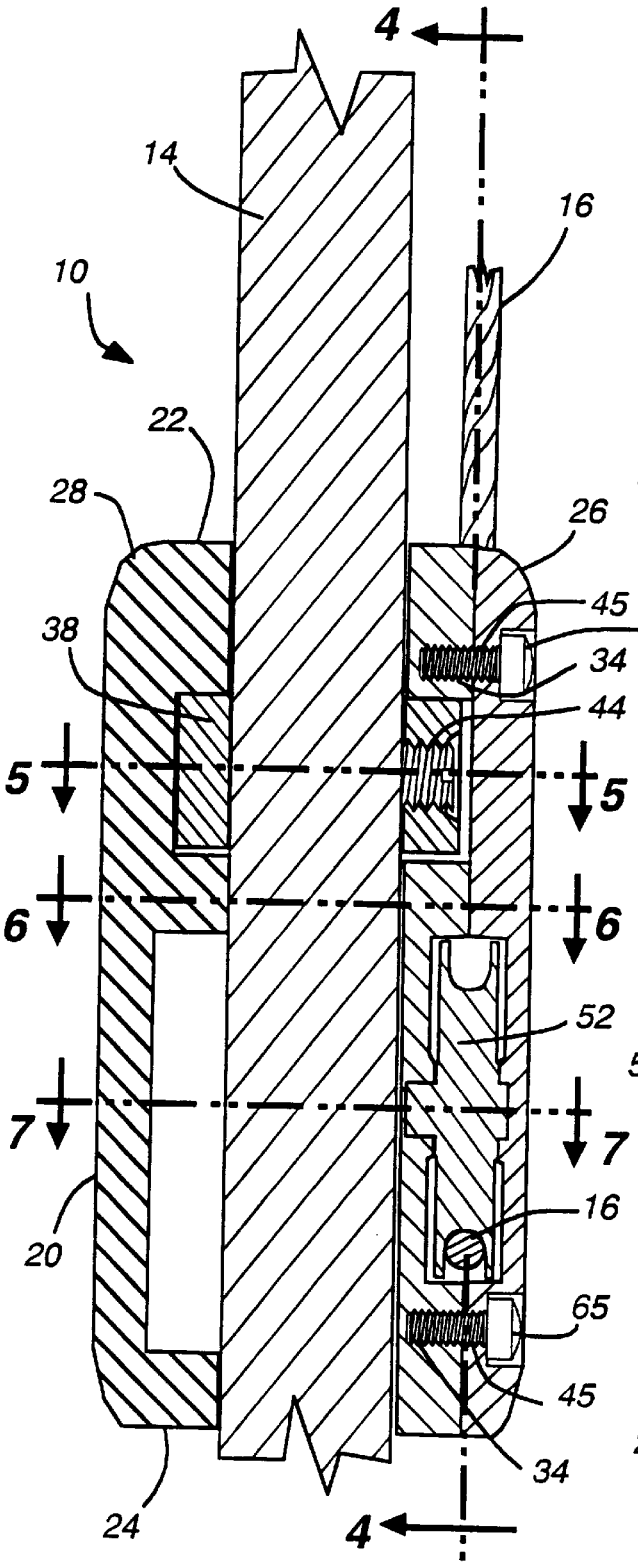
FIG. 3 is an enlarged vertical section of the coupler shown in FIGS. 1 and 2 taken along the line 3—3 of FIG. 2.
Figure 4:
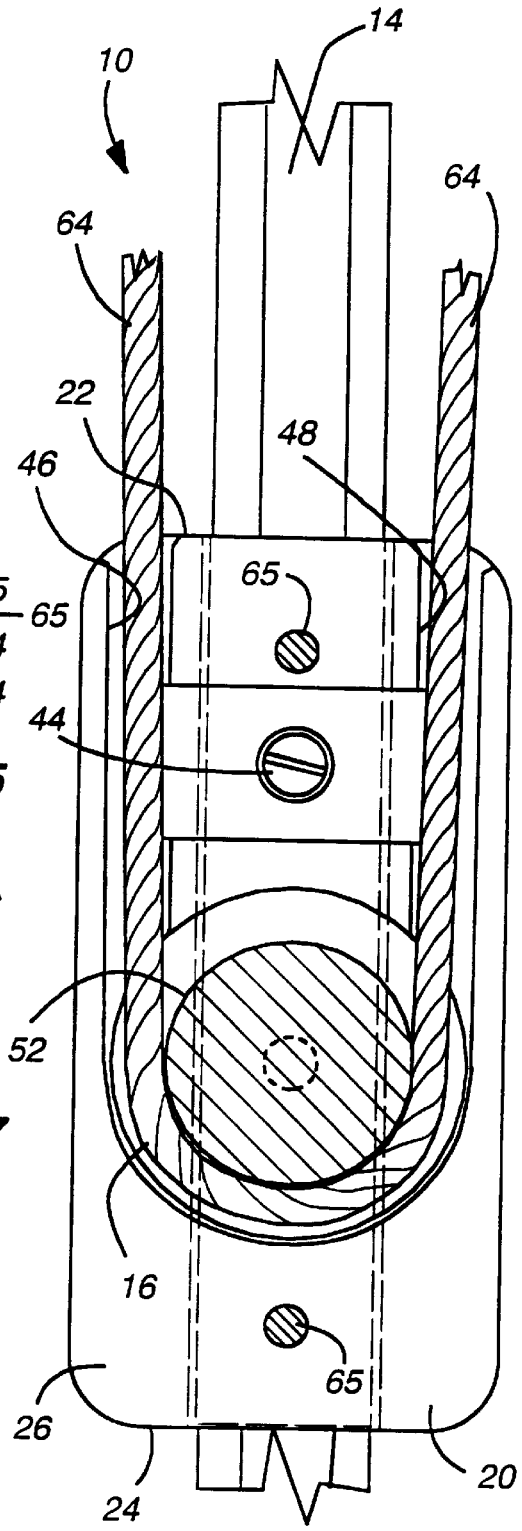
FIG. 4 is a vertical section, taken along line 4—4 of FIG. 3.
Figure 5:
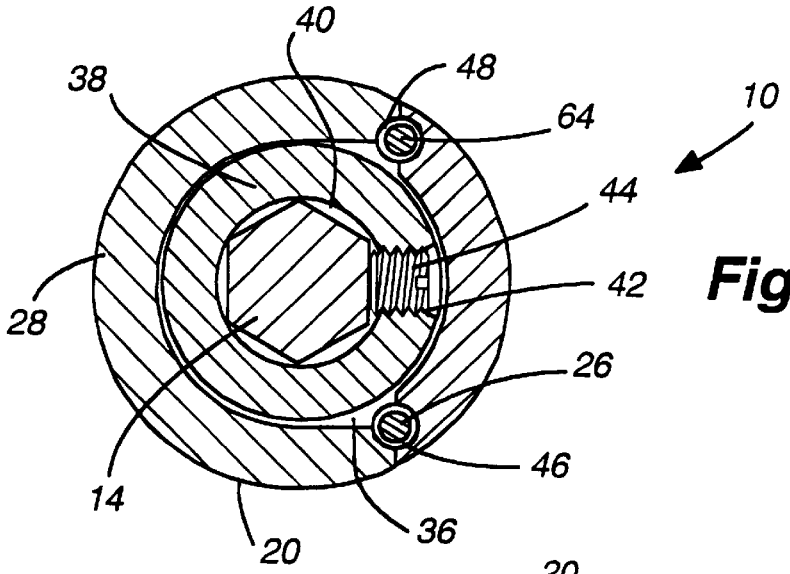
FIG. 5 is a horizontal section taken along line 5—5 of FIG. 4.
Figure 6:
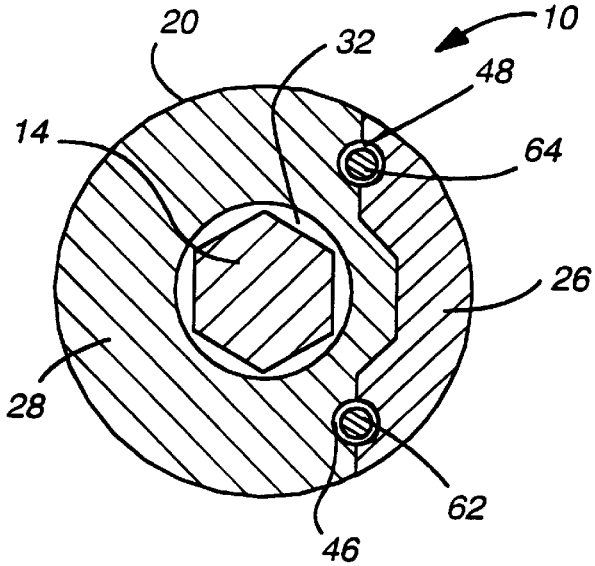
FIG. 6 is a horizontal section taken along line 6—6 of FIG. 4.
Figure 7:
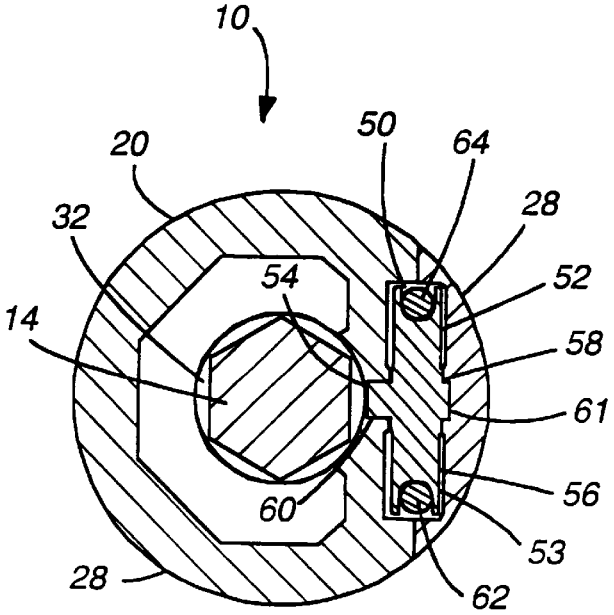
FIG. 7 is a horizontal section taken along line 7—7 of FIG. 4.

A coupler 10 of the present invention is shown in FIG. 1 in connection with a window covering 12. The window covering 12 includes a rigid tilt wand 14 and a continuous pull cord 16 to control orientation and placement of the slats 18 of the covering 12 through an elongated head rail 19 in a conventional manner. While the coupler 10 of the present invention is described in conjunction with a window covering 12 having vertical slats 18 in which adjacent slats are connected by a connecting sheet, it should be understood that the present invention is not limited to its use with vertical window blinds as shown in FIG. 1, but rather may be incorporated in a wide variety of window treatment systems, for example, vertical and horizontal venetian blinds.

As shown in FIGS. 2–9, the coupler 10 of the present invention includes a substantially cylindrical body 20 having a base portion 28 with an interior face 30 and a cap portion 26 removably connected to the base portion. The base portion has an upper surface 22 and a lower surface 24. Formed in the base portion 28 is a longitudinal or axial passageway 32 extending from the upper surface 22 to the lower surface 24, which is adapted to rotatably receive the tilt wand 14. Formed in both the base portion 28 and in the cap portion 26 of the body 20 is a transverse cylindrical pocket 36 having a segment 36*a* in the base portion 28 and a segment 36*b* in the cap portion 26. The pocket 36 is concentric with the longitudinal axis of the cylindrical body 20. Rotatably positionable within the pocket 36 is an annular collar 38 having a diameter only slightly smaller than that of the circular pocket 36. The collar 38 includes an axial aperture 40 for receiving the tilt wand 14. Also formed in the collar 38 is a transverse threaded opening 42 adapted for receiving a set screw 44.

Formed in the cap portion 26 and in the base portion 28 are complementary and confronting first longitudinal channels 46 and second longitudinal channels 48, extending longitudinally of the body 20 from the upper surface 22. The first longitudinal channels 46 are substantially parallel with the second longitudinal channels 48 and with the longitudinal passageway 32. The channels 46, as well as the channels 48, are adapted to confront each other and thereby define passageways in the body 20 of generally circular cross section and of a diameter slightly greater than the diameter of the pull cord 16. The first and second longitudinal channels 46 and 48, respectively, communicate tangentially with circular recesses 50 and 61, respectively, formed in the base and cap portions 26 and 30, respectively, of the body 20. The recesses 50 and 61 are confronting and adapted to rotatably receive a pulley 52 having a pulley groove 53 and an integral axle 54 and hub 56 arrangement which rotate about a central axis 58 of the pulley 52. The axis 58 extends diametrically of the body 20. The diameter of the recesses 50 and 61 is slightly larger than the diameter of the pulley 52. Opposing centered recesses 60, within the recesses 50 and 61, are adapted to rotatably support opposing ends of the pulley axle 54. The first pair of longitudinal channels 46 are adapted to slidably receive a first segment 62 of the pull cord 16 and the second pair of longitudinal channels 48 are adapted to slidably receive a second segment 64 of the pull cord 16. The first and second segments 62 and 64 of the pull cord 16 are integral with each other and extend around a lower half 66 of the pulley 52 within the pulley groove 53.

Formed in the interior face 30 of the base portion 28 near the upper and lower surfaces are threaded blind holes 34. Pi pair of unthreaded holes 45 corresponding to the pair of threaded holes 34 are formed in the cap portion 26. The holes 34 and 45 are alignable when the cap portion is confronted with the base portion and are adapted to receive fasteners 65 which releasably connect the cap 26 to the base 28.

To assemble the coupler 10 of the present invention on a window covering 12, the cap portion 26 of the coupler 10 is first separated from the base portion 28, exposing the interior face 30 of the base portion 28. Next, the set screw 44 is partially inserted into the threaded collar hole 42 and the collar 38 is placed in the circular pocket 36. The tilt wand 14 is then inserted into the longitudinal passageway 32 at the upper surface 22 of the body 20, passed through the central collar aperture 40 and centrally positioned in the longitudinal passageway 32 so that opposing ends of the tilt wand 14 extend beyond both the upper surface 22 and the lower surface 24 of the coupler body 20.

The pull cord 16 is then placed in the pulley groove 53, contacting the pulley 52 along the lower half 66 thereof. The pulley 52 and pull cord 16 are then placed in the first recess 50, with an end of the pulley axle 54 positioned in the associated recess 60. The first portion 62 of the pull cord 16 is then positioned in the first longitudinal channel 46 of the base 28 and the second portion 64 of the pull cord 16 is positioned in the second longitudinal channel 48 of the base 28.

The coupler base portion 28 with collar 38, pulley 52, and pull cord 16 mounted therein, is then slid along the length of the tilt wand 14 until the pull cord 16 is taut. The set screw 44 is then advanced into gripping engagement with the tilt wand 14. The cap portion 26 of the coupler body 20 is then placed in confronting relationship with the base portion 28 of the coupler body 20, with the base portion holes 34 in alignment with the corresponding cap portion holes 45. The fasteners 65 are inserted through the cap and threaded into the base portion holes 45 and 34, respectively, thereby attaching the cap portion 26 to the base portion 28 to form the integral coupler body 20.

In operation, because the tilt wand 14 extends vertically downwardly from window covering head rail 19, and because the collar 38 is fixedly connected to the tilt wand 14, the coupler 10 of the present invention maintains a vertical orientation in which the upper and lower surfaces 22 and 24 are maintained in a substantially horizontal orientation, the longitudinal passageway 32 and the first and second longitudinal channels 46 and 48 are maintained in a substantially vertical orientation, and the coupler 10 is maintained at a fixed position along the length of the tilt wand 14. Because the coupler 10 is fixedly positioned on the tilt wand 14, the first and second segments 62 and 64 of the continuous pull cord 16 are taut and the pull cord 16 remains taut whether the window covering 12 is fully retracted, partially retracted, fully open, or under adjustment through manipulation of the pull cord 16. When the distance between the first and second longitudinal channels 46 and 48 is sufficiently small, the first and second segments 62 and 64 of the pull cord 16 will remain closely spaced and difficult to spread apart.

Moreover, because the fixed coupler 10 maintains tension on the pull cord 16, the first and second segments 62 and 64 of the pull cord 16 are kept in a substantially parallel relationship along their length from the coupler 10 to the head rail. As a result, a neat and aesthetically appealing appearance is maintained for the window covering 12.

Despite the tension maintained on the pull cord 16 by the coupler 10, the tilt wand 14 can be freely rotated within the coupler 10 and the slats 18 of the window covering 12 can thus be freely tilted or rotated, as the case may be. This is because the collar 38, which is fixedly mounted to the tilt wand 14, is of a diameter smaller than the circular pocket 36 in which it is positioned, and thus rotates freely within the circular pocket. Rotation of the collar 38 and the associated tilt wand 14 is not obstructed by the set screw 44, which, when fully inserted into the collar hole 42, does not extend beyond the outer diameter of the collar 38.

A presently preferred embodiment of the present invention and many of its improvements have been described with a degree of particularity. It should be understood that this description has been made by way of preferred example, and that the invention is defined by the scope of the following claims.

What is claimed is:

1. An operating system for a window covering comprising:

an elongated tilt wand, a pull cord and a coupler for operatively connecting the tilt wand and the pull cord, said coupler having a body with a longitudinal passageway formed therein for rotatable receiving said tilt wand, a first longitudinal channel formed therein for receiving a first segment of said pull cord, a second longitudinal channel formed therein for receiving a second segment of said pull cord; and wherein said coupler includes means for gripping said tilt wand to maintain the position of said coupler at a predetermined location along the length of said tilt wand while allowing the tilt wand to rotate about a longitudinal axis relative to the coupler and for maintaining tension on said pull cord.

2. The system according to claim 1 wherein the means for gripping the tilt wand and said cord tension maintaining means include:

an annular collar having a central collar opening formed therein for receiving said tilt wand;

means for fixedly connecting said collar to said tilt wand; and a pocket formed in said body in communication with said longitudinal passageway for receiving said collar.

3. A control system for a window covering, said control system including a tilt wand, a control cord and a coupler for operatively interconnecting the tilt wand and control cord, said coupler comprising:

an annular collar adapted to encircle and grip a portion of said tilt wand; and a body having (a) a longitudinal passageway formed therein for rotatably receiving said tilt wand, (b) a pocket formed therein in communication with said longitudinal passageway for rotatable receiving said annular collar, (c) a first longitudinal channel formed therein for receiving a first segment of said pull cord, and (d) a second longitudinal channel formed therein for receiving a second segment of said pull cord.

4. A control system for a window covering having selectively movable components, said control system including a tilt wand, a control cord and a coupler operatively interconnecting the tilt wand and pull cord, said components being operatively controlled by said tilt wand and pull cord, said tilt wand comprising in combination an elongated substantially rigid rod with said coupler being mounted thereon, said coupler comprising:

a body having a longitudinal passageway formed therein for rotatable receiving said tilt wand, a first longitudinal channel formed therein for receiving a first segment of said pull cord, a second longitudinal channel formed therein for receiving a second segment of said pull cord; and means on said coupler for engaging said substantially rigid rod and maintaining the position of said coupler at a predetermined location along the length of said substantially rigid rod and for maintaining tension on said pull cord.

5. The system according to claim 4 wherein the means for engaging said substantially rigid rod and for maintaining tension on said pull cord include:

an annular collar having a central collar opening formed therein for receiving said substantially rigid rod;

means for fixedly connecting said collar to said substantially rigid rod; and a pocket formed in said body in communication with said longitudinal passageway for receiving said collar.

6. A coupler for a window covering having a pull cord and a tilt wand, said coupler comprising:

a body having a longitudinal passageway formed therein for receiving said tilt wand, a first longitudinal channel formed therein for receiving a first segment of said pull cord, a second longitudinal channel formed therein for receiving a second segment of said pull cord; and means for maintaining the position of said coupler at a predetermined location along the length of said tilt wand and for maintaining tension on said pull cord, said means including a pulley having a pulley groove adapted for receiving said pull cord and a first recess formed in said body in communication with said first and second longitudinal channels adapted to receive said pulley.

7. The coupler according to claim 6 wherein said pulley further includes an axle extending transversely from the center of said pulley and wherein said body further includes a second recess formed therein in communication with said first recess and adapted to receive said pulley axle.

8. A coupler according to claim 6 wherein the coupler body further comprises a base portion and a cap portion.

9. A coupler for a window covering having a pull cord and a tilt wand, said coupler comprising:

a body having a longitudinal passageway formed therein for receiving said tilt wand, a first longitudinal channel formed therein for receiving a first segment of said pull cord, a second longitudinal channel formed therein for receiving a second segment of said pull cord; and means for maintaining the position of said coupler at a predetermined location along the length of said tilt wand and for maintaining tension on said pull cord, said means including an annual collar having a central collar opening formed therein for receiving said tilt wand, means for attaching said collar to said tilt wand, a pocket formed in said body in communication with said longitudinal passageway and adapted to receive said collar, a pulley having a pulley groove adapted to receive said pull cord and an axle extending centrally therefrom about which the pulley rotates, a first recess formed in said body and connecting said first and second longitudinal channels, and opposing second and third recesses formed in said body in communication with said first recess, wherein said first recess is adapted to receive said pulley and said second and third recesses are adapted to receive said axle of said pulley.

10. A coupler according to claim 9 wherein said collar mounting means includes:

a transverse hole formed in said collar; and a fastener adapted to be received in said hole to fixedly engage said tilt wand.

11. A coupler for a window covering having a pull cord and a rigid tilt wand, said coupler comprising:

an annular collar adapted to fixedly encircle a portion of said tilt wand;

a body having (a) a longitudinal passageway formed therein for rotatably receiving said tilt wand;

(b) a pocket formed therein in communication with said longitudinal passageway for receiving said annular collar;

(c) a first longitudinal channel formed therein for receiving a first segment of said pull cord; and (d) a second longitudinal channel formed therein for receiving a second segment of said pull cord;

a pulley having a pulley groove adapted for receiving said pull cord; and a first recess formed in said body, connecting said first and second longitudinal channels and adapted to receive said pulley.

12. The system according to claim 11 wherein said pulley further includes an axle extending transversely from the center thereof and wherein said body further includes a second and a third recess formed therein extending from said first recess, for receiving said axle.

13. A tilt wand and coupler combination for a window covering having selectively movable components which are operatively controlled by said combination and a pull cord, said combination comprising in combination:

an elongated substantially rigid rod and a coupler mounted thereon, said coupler comprising:

a body having a longitudinal passageway formed therein for receiving said tilt wand, a first longitudinal channel formed therein for receiving a first segment of said pull cord, a second longitudinal channel formed therein for receiving a second segment of said pull cord; and means for maintaining the position of said coupler at a predetermined location along the length of said substantially rigid rod and for maintaining tension on said pull cord, said means including a pulley having a pulley groove adapted for receiving said pull cord and a first recess formed in said body in communication with said first and second longitudinal channels and adapted to receive said pulley.

14. The tilt wand according to claim 13 wherein said pulley further includes an axle extending transversely from the center of said pulley and wherein said body further includes a second recess formed therein in communication with said first recess and adapted to receive said pulley axle.

15. A tilt wand according to claim 13 wherein the coupler body further comprises a base portion and a cap portion.

16. A tilt wand and coupler combination for a window covering having selectively movable components which are operatively controlled by said combination and a pull cord, said combination comprising:

an elongated substantially rigid rod and a coupler mounted thereon, said coupler comprising:

a body having a longitudinal passageway formed therein for receiving said tilt wand, a first longitudinal channel formed therein for receiving a first segment of said pull cord, a second longitudinal channel formed therein for receiving a second segment of said pull cord; and means for maintaining the position of said coupler at a predetermined location along the length of said substantially rigid rod and for maintaining tension on said pull cord, said means including an annular collar having a central collar opening formed therein for receiving said substantially rigid rod, means for attaching said collar to said substantially rigid rod, a pocket formed in said body in communication with said longitudinal passageway and adapted to receive said collar, a pulley having a pulley groove adapted to receive said pull cord and an axle extending centrally therefrom about which the pulley rotates, a first recess formed in said body and connecting said first and second longitudinal channels, and opposing second and third recesses formed in said body in communication with said first recess, wherein said first recess is adapted to receive said pulley and said second and third recesses are adapted to receive said axle of said pulley.

17. A tilt wand according to claim 16 wherein said collar mounting means includes:

a transverse hole formed in said collar; and a fastener adapted to be received in said hole to fixedly engage said substantially rigid rod.

* * * * *

UNITED STATES PATENT AND TRADEMARK OFFICE

CERTIFICATE OF CORRECTION

PATENT NO. : 5,853,039

DATED : Dec. 29, 1998

INVENTOR(S) : Donald E. Fraser, et al.

It is certified that error appears in the above-identified patent and that said Letters Patent is hereby corrected as shown below:

Column 5, line 16 (claim 1) replace "rotatable" with -- rotatably --

Signed and Sealed this

Tenth Day of August, 1999

*Attest:*

Q. TODD DICKINSON

*Attesting Officer*

*Acting Commissioner of Patents and Trademarks*